US006193076B1

(12) United States Patent
Hensley

(10) Patent No.: US 6,193,076 B1
(45) Date of Patent: Feb. 27, 2001

(54) DRILLING FLUID PURIFICATION METHOD AND APPARATUS

(75) Inventor: Gary L. Hensley, Kingwood, TX (US)

(73) Assignee: Hutchison-Hayes International, Inc., Houston, TX (US)

( * ) Notice: Subject to any disclaimer, the term of this patent is extended or adjusted under 35 U.S.C. 154(b) by 0 days.

(21) Appl. No.: 09/199,700

(22) Filed: Nov. 25, 1998

(51) Int. Cl.[7] ..... B04B 1/00

(52) U.S. Cl. ..... 210/374; 210/360.1; 210/380.1; 210/380.3; 494/36; 494/53

(58) Field of Search ..... 210/360.1, 374, 210/380.1, 380.3; 494/36, 53

(56) References Cited

U.S. PATENT DOCUMENTS 4,298,159 * 11/1981 Epper et al. ..... 494/35
5,403,260 * 4/1995 Hensley ..... 494/53
5,942,130 * 8/1999 Leung ..... 210/781

* cited by examiner

*Primary Examiner*—David A. Reifsnyder
(74) *Attorney, Agent, or Firm*—Felsman, Bradley, Vaden, Gunter & Dillon, LLP

(57) ABSTRACT

This disclosure sets forth a method and apparatus for operation of a centrifuge. It is constructed with a fluid inlet at one end delivering a liquid flow into a feed pipe and then into a rotating bowl. The bowl has an outer wall which is cylindrical and which is formed of adjacent individual pieces defining gaps between pieces. In one embodiment, 960 pieces define 960 parallel slots. The slots are quite narrow, having a width of 80 microns to thereby exclude particles larger than that. The mud flow is introduced into the bowl region, and a flited conveyor is operated to scroll the particles along the bowl towards the opposite end, a tapered beach cone, and that terminates at a set of discharge openings. Dry powder too large to pass through the slots is discharged from there. While the slots discharge the mud, particles are removed by this approach.

11 Claims, 2 Drawing Sheets

DRILLING FLUID PURIFICATION METHOD AND APPARATUS

BACKGROUND OF THE DISCLOSURE

Drilling mud systems normally involve the mixing of components of the earth in a solvent. Sometimes, the solvent is water, and sometimes it is oil comparable to diesel oil. Such a drilling mud system is normally a mixture of barites, components of the earth, which are mixed into the solvent. Roughly, they have a density of about 4.4 using water as a density of 1.0. This density or specific gravity defines the basic two component system. After use, the drilling fluid is returned to the surface. It is usually returned with a mix of cuttings which are pulverized into a wide range of particle sizes. The particles are removed and the drilling fluid is recirculated. Throughout the project, it is necessary to clean up the drilling fluid. The drilling fluid is three components. The major component in terms of volume is the solvent. Again, typically, it is water or diesel oil. The third component that is added all the time through the drilling process is particles from the drilling process. These can be relatively large. The third component is derived from the components of the earth, typically, sand or shale, and these constitute a significant portion of the returned drilling fluid. In fact, they are the portion that corrupts or spoils the drilling fluid.

It is important in determining a mud system for a given well that the weight of the mud must be controlled to a specified elevated level. The weight of the mud is increased from 8 pounds per gallon (the baseline value associated with pure water) up to 12, perhaps 14 and even 16 pounds. This gain in weight is achieved by adding barites. During use, the weight must be stabilized. Otherwise, the mud is not useful. Sometimes it is passed through degassers, desanders, shale shakers, and other equipment to clean the mud during use. Whatever the circumstance, the drilling fluid cuttings are ultimately a waste product from the drilling process that is difficult to dispose of. Cuttings may include components which are removed, if possible, and the present disclosure sets forth an approach for doing that. It is not uncommon for a mud system to involve 1,000 or more barrels. It is not uncommon to have as much as $1 million of mud flowing in the system depending on the components in it. In terms of cleaning the mud system and breaking it down into easily segregated ingredients, the best that has been done in the past has primarily been screening of the heavy particles which derive from the drilling process itself. That is a good first step, but it is not adequate.

For a more adequate approach, the cleaning of the present disclosure is the retrieval of the mud and centrifuging it into two components, one being the mud and the other being solids which are removed from it. In particular, this system works well to remove cuttings in the drilling fluid and to enable recovery of the solids in the drilling fluid, thereby removing waste products for continued drilling. Effectively, the expensive process of cutting disposal is significantly avoided and cuttings are converted into segregated byproducts leaving the mud recovered from it.

This disclosure is directed to an improved centrifuge which especially finds use in cleaning drilling mud. In particular, it is able to extract sand and shale in the drilling mud. The present system is summarized as an improved centrifuge having a rotating bowl which is constructed with a set of slots in it so that it has controlled leakage through the bowl. The bowl is tapered at one end to connect with an inlet line. The drilling mud introduced at that end is delivered into the bowl and is directed outwardly by a set of acceleration vanes. They force the liquid to flow to the outside, rotating on the interior of the bowl. As it flows along the bowl, the liquid is permitted to pass through a set of slots. The slots are relatively narrow so that particles above a certain size do not pass through the slots. The particles that are too large for the slots remain on the interior of the bowl and are picked up by the flites of the conveyor which is a single helix screw of about 5 to 10 turns. The flites extend outwardly to a common diameter adjacent to the bowl. At the remaining end, the flites taper inwardly to cooperate with a solid wall beach tapered end of the bowl. The beach terminates at a set of openings where the dry components are forced to the left and out of the bowl at a solids outlet. A surrounding housing includes an internal wall dividing the housing. The housing is stationary over the bowl. It includes a liquid discharge outlet at the center and a solids discharge at the end adjacent to the beach.

In one important aspect, a slotted bowl is constructed for this equipment. The bowl is not made of one piece; in this instance, the bowl is constructed of a number of segments. The segments are positioned so that they define a number of slots of common length. This unitized construction enables the bowl to be assembled with a requisite number of slots around the circle. For example, the bowl can be readily made with a selected number of slots. In the preferred embodiment, the bowl is assembled with 960 slots around the circle, the preferred bowl diameter being 36 inches. This provides an adequate slot area for large production. The length of the bowl is incremental. To assure that centrifugal forces do not bow the components and thereby distort the slots between adjacent pieces, they are relatively short. Arbitrarily assigning a length of about 5 inches, each of the several slots is made identically to all the others, and this is replicated so that the bowl length is 5 inches or multiples thereof. By making the slot to a specified width, the preferred embodiment being approximately 0.003 inches, the slots in a 5 inch long segment provide a cross-sectional area of about 15 inches as a feed through. A 15 inch cross-sectional area is sufficient to process 100 gallons or more per minute through the centrifuge. By expanding the bowl in length, capacity can be increased to 200, 300 and so on.

DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENTS

Figure 1:
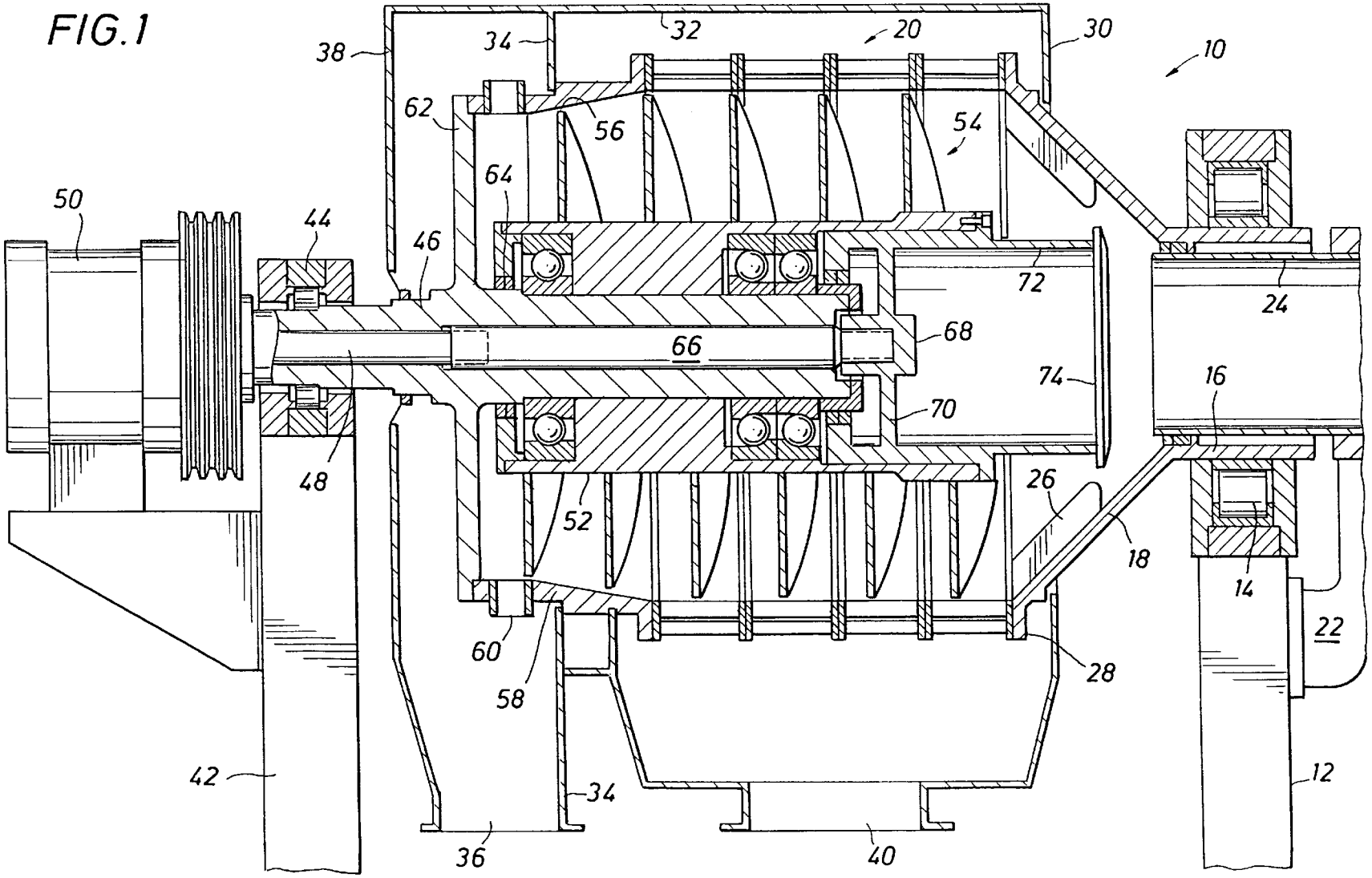
FIG. 1 is a sectional view through the centrifuge of the present disclosure showing a gearbox at the left end and a fluid inlet at the right end for a fluid to be separated, and additionally showing a solids outlet and liquids outlet along the bottom of the centrifuge.

Attention is now first directed to FIG. 1 of the drawings where the numeral 10 identifies the centrifuge system of the present disclosure. Proceeding with the description from the right hand end, the numeral 12 identifies an upstanding support post. The post 12 extends upwardly and provides support for a bearing assembly 14. The bearing assembly 14 is positioned around a sleeve 16. The sleeve connects to a tapered solid wall conic member 18 which defines the tapered end of the rotatable bowl. The bowl is generally indicated by the numeral 20. The outer wall of the bowl is an elongate cylindrical structure extending from the tapered conic portion 18 previously mentioned. The numeral 24 indicates a nonrotating feed pipe which is supported on a laterally extending arm 22 which reaches up and clamps around the pipe. While the pipe 24 is held stationary, it is received inside the bearing assembly and is sealed against that assembly. The fluid system provides a flow through the pipe 24 introduced to the interior of the conic member 18, and the liquid flow, on entry into the rotating centrifuge 20, is picked up and accelerated. It flows around the radial vanes 26 which direct the flow outwardly. The vanes 26 are in the interior of the conic member 18. Both of them extend radially outwardly and terminate at the end of the elongate right cylinder defining the structure. The exterior of the bowl is an elongate cylindrical shape which is held together by a series of bolts 28. They fasten together to hold the components together. The bolts 28 serve as fasteners to assure that the components of the bowl have the required geometric shape. In general terms, the bowl is an elongate cylinder, having left and right hand ends which taper in conic fashion. This rotating member is provided with a rotative force through a gearbox to be described so that the bowl is rotated. As will be detailed, a conveyor or screw having a helical screw moves the heavier particles to the left for ejection, and the liquid solvent flows through a set of slots as will be described. This separates the solvent from particles above a certain size carried in the solvent making up the drilling mud.

As noted earlier, the flow of fluid to be separated into the centrifuge 10 is through the pipe 24. It is delivered on the interior of the conic shaped end member 18 and is spun to the outer face or wall of the bowl 20. The bowl 20 is surrounded by a nonmoving shell, and more particularly a clam shell housing or cabinet 30 which is constructed around the bowl. It does not rotate. Rather, it includes a cylindrical outer wall 32 and an internal partition 34. The partition 34 extends fully around the bowl and is shown at lower portions of FIG. 1 where it connects into a downwardly directed chute 36 which is the solids outlet. The end 38 of the housing 30 is also closed so that no fluid escapes in that region.

The housing is typically cylindrical and roughly parallel around the bowl 20 on all sides and upper portions which enclose the rotating bowl. Along the lower portions, there is a liquid discharge outlet 40 which extends downwardly. The partition 34 divides the centrifuge outlets. Moreover, the beach as will be described directs the solids to the far left while the liquid component separated by the system goes through the bowl and is directed radially outwardly. It flows downwardly through the outlet 40.

The housing surrounds a drive shaft and sleeve. This involves the left hand end of the equipment which includes the upstanding post 42 which in turn supports a bearing assembly 44. The bearing assembly 44 enables the entire equipment to be aligned appropriately. There are two rotative members to be noted at this location. The first is an external sleeve 46, and that in turn surrounds (on the exterior) an internally located shaft 48. Both are rotated by a planetary gearbox 50. The gearbox mechanism is provided with power which is input to it to prompt rotation of the components as will be noted. The gearbox 50 rotates the hollow sleeve 46 and the shaft 48 on the interior. It is sized or scaled to operate where the bowl is rotated at a relatively slow speed. A speed of about 375 rpm will provide approximately 70 times the force of gravity.

In other words, the granules of greater density in the mud solvent (water or oil) are forced to the bottom of the pond by a force which is about 70 times greater than gravity. This 70 g-force acting on the particles settles the particles rapidly. Where possible, the particles will pass through the slots. In the preferred embodiment, the slots are about 0.003 inches wide or about 80 microns in width. This is a useful dividing line. Particles larger than that will not pass through the slots and remain inside the bowl. Smaller particles which will be known as "fines" flow with the liquid through the slots at the bottom of the pond. In fact, the bottom of the pond ejects liquid by centrifugal forces directing the liquid flow through the slots around the bowl so that the liquid flows out the liquid outlet 40. The liquid at the outlet does not include large particles because they are left in the bowl. By rotating the bowl at about 375 rpm, sufficient centrifugal forces are generated to obtain the forgoing separation. The bowl rotates at a velocity which is close to the velocity of an internal conveyor. The conveyor is adjusted by the gearbox 50 so that it rotates at about 8 rpm speed difference. The flites of the conveyor are mounted on the exterior of a cylindrical housing 52, the flites being indicated generally at 54. The flites have a uniform pitch and diameter adjacent to the bowl, but they taper at the left hand end to a smaller flite radius at 56. This tapering arrangement conforms to the tapered beach 58 which is an elongate, concentric, centered housing member. It has a width equal to the bowl at the large end and tapers to a smaller end. This is made of a tapered shell of circular construction which is provided with a number of discharge ports 60 which direct the dry particles radially outwardly. They are thrown outwardly to impinge on the cylindrical shell or housing 32 and are deflected downwardly into the dry outlet 36 at the bottom. The rotating beach 58 is tapered so that it raises the dry particles at the left end through the surface of the pond. The level of the pond does not cover the entire beach. In other words, the openings 60 are dry because the depth of liquid does not reach that high, a height sufficient to flood the openings. The openings 60, therefore, receive the dry material which is scrolled by the turns of the helical conveyor 54. The relative speed and the lead of the screw move dry particles to the left and up the beach. When ejected through the ports 60, the particles are significantly dry and they are ready to be recycled. The dry particles are ejected and separated.

The beach 58 terminates at a solid end hub 62 which extends radially outwardly. The hub itself is integrally joined to the sleeve 46. The sleeve is supported for rotation on a suitable bearing assembly 64. Again, it should be noted that the sleeve 46 and the shaft 48 are both rotated from the gearbox 50. The gearbox provides a speed differential. The shaft 48 is connected through a spline connection with another shaft member 66 which extends further in the structure and terminates at the cap 68. The cap 68 is integrally constructed with a cap plate 70 connected with a cylindrical wall 72 which closes off the internal chamber. Appropriate seals are included to prevent leakage into the chamber 72. The chamber is covered at one end with a circular plate 74. The shaft 48, the spline connected shaft 66 and the cap plate 70 all rotate as a unit.

OVERVIEW OF BOWL CONSTRUCTION

The bowl 20 is porous at the central, cylindrical portion, and is made of solid wall conic members at the two ends. It rotates as a unit. The pond is accumulated in the bowl 20 to a selected depth. The pond comes up on the tapered surface at the beach 58. The liquid level does not rise to the level of the drain ports 60. They are at the high end of the beach and therefore are dry. The flites of the conveyor are rotated relatively so that particles are lifted out of the pond and pushed from right to left and up the slope. This dries the particles. Any liquid on the beach 58 flows back down into the pond. The discharge through the ports 60 is primarily dry particulate material. These particles, once removed from the remaining liquid, change the weight of the drilling mud and the nature of liquid or solvent remaining.

The system removes large particles. Those are defined as particles above a specified diameter, typically larger than about 80 microns. This leaves only the fines in the fluid discharged for subsequent treatment by another stage of centrifugal separation or by other techniques.

The system operates pressure at the bowl to force the liquid to flow through the bowl. The liquid is thrown radially outwardly, deflected by the fixed housing 32, and then runs down and out the liquid port 40. This arrangement assures that the liquid is segregated from the significantly drier particles ejected through the port 36.

Figure 2:
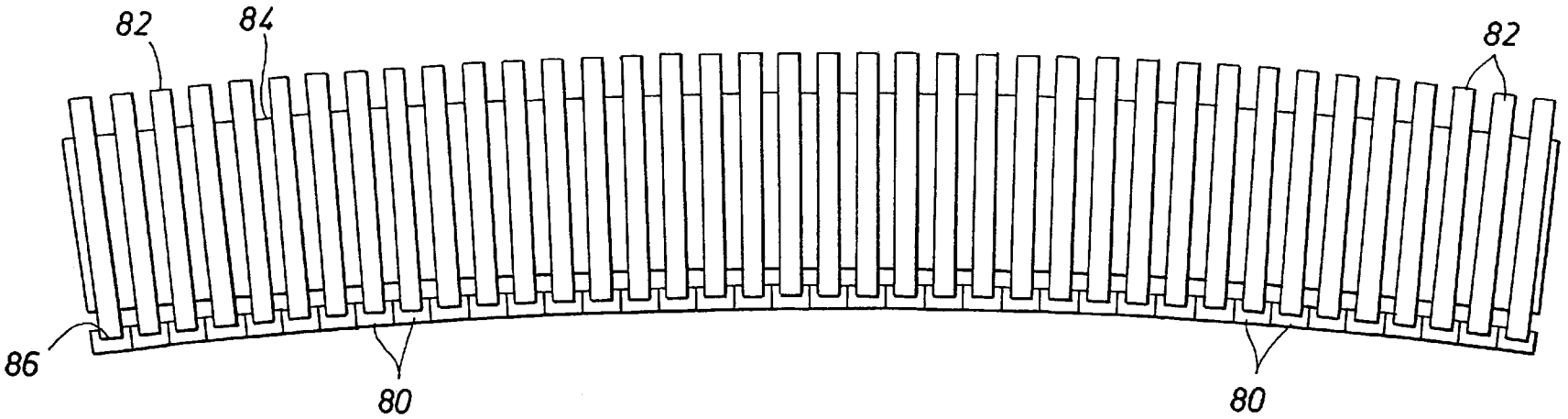
FIG. 2 is a side view of a portion of the screen plate assembly which extends fully around the bowl and which makes up part of the bowl, and which shows a set of cap tiles which are joined with such slots to form an encircling bowl subassembly.
Figure 3:
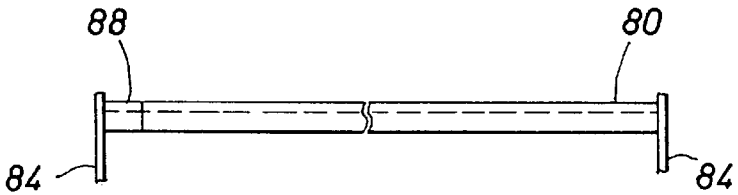
FIG. 3 is a view of a single cap tile.

Attention is now directed to FIGS. 2 and 3 of the drawings. FIG. 3 will be considered only briefly. In essence, the structure of FIG. 3 is an elongate U-shaped block. The component is identified as a cap tile 80 which is joined to a screen plate 82 (see FIG. 2) and the screen plate 82 is attached to a circular retainer ring 84. Going now to FIG. 2 and considering these components carefully, it shows a set of the cap tiles 80 which are adjacent to each other. Each cap tile has a long side (note the relative scale in FIG. 3). The cap tile 80 has a width of a fraction of an inch and straight side walls with a groove 86 down the center of the cap tile. The tiles 80 are all formed of a relatively hard and durable material, preferably tungsten carbide in a supportive metal alloy matrix. This is a relatively brittle structure. It is made of this hard material for long life. Because it is hard and tends to be somewhat brittle, it has some difficulty in loading. Therefore, it is installed with the plate 82 which is known as a screen plate. While extra height is excessive in the sense that great height is not needed, it is included to define a groove which tends to draw fluid through the groove between adjacent screen plates 82. This groove region is a fluid flow passage which tends to clear the gap. Now, viewing adjacent tiles 80, they are abutted against each other along the common faces (the long side thereof) and are spaced apart by shims. The shim width matches that desired value and in this instance, a shim washer is inserted at each end of the cap tile 80. This is the washer 88 shown in FIG. 3, and the comparable washer is placed at the opposite end. In both instances, the shim is only 0.003 inches in thickness, and by positioning the shim at both ends, a slot of rectangular construction is defined. Looking at FIG. 2 of the drawings, the slot opens from the bottom upwardly into the larger groove. Because the members are divergent, being positioned around a circle, particles that pass through the slot move outwardly and pick up velocity in that region and escape more rapidly. The forces acting on droplets and particles in this region are directed radially outwardly so that there is no accumulation in the narrow gap. They all escape and are thrown radially outwardly.

The plate 84 is a retainer ring which is positioned at the end of the tile 80, there being one at the left end and one at the right end, also. These stabilize and position the several tiles 80. In the preferred embodiment, 960 tiles are around the circle. They are abutted between a pair of the retainer plates 84. The retainer plates abut against the screen plates 82 also and are spot welded to them. This assures that the screen plates are fixably held at both ends. They are held in place between the matching and facing retainer rings 84. By this construction, a stable structure is achieved, and the tiles on the interior are therefore not significantly loaded with any forces. When the equipment is pulled together and clamped at the time of assembly, the clamping action holds the screen plate 82 and not the tile. The several tiles are thus stabilized in position to define parallel and fixed slots, there being 960 tiles in the circle, hence 960 slots. By appropriate positioning of the shim between adjacent cap tiles 80, the entire circle is built up.

Going back to FIG. 1, the screen plates and tiles are attached in the described fashion and are stacked to form first, second, third and fourth rings in the illustrated embodiment. That can be decreased or increased to any number. In general terms, the slotted assemblies discussed in detail regarding FIGS. 2 and 3 are separate units which are attached in a stacked fashion and are held together by the bolts 28 which clamp on the exterior.

The assembly shown in FIG. 2 fabricates the requisite and necessary structure while holding the circular shape when stacking to the right height. Once the bolts 28 are in place, the structure is rigid. It is replicated to the extent desired by simply stacking several of those together. As will be understood, the retainer ring 84 is equipped with spaced tabs to enable it to align with the bolts 28 which go around the assembled bowl.

MUD PURIFICATION SYSTEM

Consider a situation in which a mud flow is obtained from a well after a drilling program. Assume further that the mud is made of any of the common solvents, water being the most common, and an oil based solvent being the second most common. In the latter event, the oil is like diesel oil. Sometimes, synthetic oils are used. These are occasionally known as "palm oil" and in this instance, the oils can have prices ranging from about $20 per barrel to perhaps $300 per barrel in 1998 prices. Assume also that weight material is in the mud. The weight material is typically barites and has a density of around 4.4. Assume, also, that practically all of the weight material is relatively small particles, i.e. those which are less than about 80 microns and that some of the particles are crushed in processing and becomes much smaller than 80 microns. This mud is introduced into the equipment illustrated in FIG. 1. It is operated at about 70 g's of force, this being accomplished at 375 rpm with a 36 inch diameter bowl. With a scrolling speed of about 8 rpm differential, the equipment separates the larger cuttings or particles. With a gap or spacing of 80 microns, the system removes all of the weight material larger than 80 microns to markedly reduce the trash in the mud. It recovers a nearly dry powder. While not dry like sand, it is sufficiently dry to be bagged and shipped to a trash disposal. This enables mud recirculation in the well using the reclaimed mud. This step reduces the trash in the clean discharged mud. The process of the present disclosure therefore contemplates recovery of all of the particles above the gap dimension. Effectively, this provides the segregated output. Further processing of the nearly dry cuttings is not generally required.

While the foregoing is directed to the preferred embodiment, the scope is determined by the claims which follow:

What is claimed is:

1. A mud cleaning apparatus for removing well borehole particles from a wellbore hole carried in drilling fluid which is comprised of a solvent and a weight material in the solvent, the apparatus comprising:

(a) a rotatable elongate housing having an axis of rotation. two ends , an inside and a plurality of axially oriented slots through the housing the plurality of axially oriented slots being oriented parallel to said axis of rotation;

(b) a flow pipe for introducing drilling fluid with particles in one end of said rotatable housing;

(c) an elongate screw having a flite extending therearound wherein said flite defines an outer edge and the outer edge is sized to fit inside said housing and rotate so that the flite is in contact with the inside of said housing; and (d) a housing outlet at a second end thereof for removing the particles from the drilling fluid wherein the outlet is elevated with respect to drilling fluid in said housing, and said elevated location is positioned so that the particles in the drilling fluid are scrolled to the outlet.

2. The apparatus of claim 1 further comprising:

(a) a tapered cone at said flow pipe and joined to said housing for rotating with said housing, the cone defining an internal surface; and (b) a vane on the internal surface of the cone for rotating with said housing.

3. The apparatus of claim 1 wherein said housing comprises:

(a) an assembly of circular construction having
(i) replicated slots
(ii) between adjacent parallel blocks
(iii) separated by a slot defining distance, and
(iv) stacked to form a complete circle
(v) from N parallel blocks wherein N is a positive integer; and (b) a circle defining fixture holding said blocks in a circle to define a common internal surface and said slots are in said common internal surface so that said slots enable drilling fluid to flow to the exterior of said housing.

4. The apparatus of claim 3 wherein said slots define a common width classifying particle in said housing.

5. The apparatus of claim 4 wherein said housing is fabricated from at least two of said assemblies serially connected.

6. The apparatus of claim 5 wherein said housing assemblies are held together by externally located assembly fasteners.

7. The apparatus of claim 3 including a structural support member contacting said block to relieve block stress and reduce loading thereof.

8. A fluid clarification centrifuge comprising:

a. a rotatable elongate housing having an axis of rotation and comprising:
i. a cylindrical center section having an inside surface and a plurality of axially extending slots through the center section, the plurality of axially oriented slots being oriented parallel to said axis of rotation;
ii a fist tapered end extending from a first end of the canter section, the first tapered end having an inside surface;
iii a second tapered end extending from a second end of the center section, the second tapered end having an inside surface;

b. a flow pipe for introducing a fluid to be clarified into the first tapered end of the housing;

c. an elongate screw sized to fit on the inside surface of the center section and the second tapered end of the housing; and d. a housing outlet through the second end of the housing.

9. The centrifuge of claim 8, further comprising a radially extending vane on the inside surface of the first tapered end.

10. The centrifuge of claim 8, wherein the center section of the housing comprises an assembly of circular construction having a plurality of cap tiles which define the slots.

11. The centrifuge of claim 10, further comprising a circle defining fixture holding the cap tiles to define the inside surface of the center section of the housing and the cap tiles are in the inside surface of the center section of the housing to enable the fluid to be clarified to flow through the slots.

* * * * *